US005720662A

United States Patent [19]

Holmes, Jr. et al.

[11] Patent Number: 5,720,662

[45] Date of Patent: Feb. 24, 1998

[54] SLOT MACHINE METHOD

[76] Inventors: Verne F. Holmes, Jr., 8625 Rosada Way, Las Vegas, Nev. 89121; Linton Mathews, 6621 Cowboy Trail, Las Vegas, Nev. 89131

[21] Appl. No.: 640,571

[22] Filed: May 1, 1996

[51] Int. Cl.[6] ..... G07F 17/34

[52] U.S. Cl. ..... 463/20

[58] Field of Search ..... 463/16, 17, 18, 463/19, 20, 21, 22, 23; 273/144 R, 138.2, 274

[56] References Cited

U.S. PATENT DOCUMENTS

| | | | |
|---|---|---|---|
| 4,200,291 | 4/1980 | Hooker | 273/143 |
| 4,241,920 | 12/1980 | Hooker | 273/143 |
| 4,508,345 | 4/1985 | Okada | 273/143 |
| 5,154,421 | 10/1992 | Hamamo | 273/143 |
| 5,303,919 | 4/1994 | Takemoto et al. | 273/143 |
| 5,375,830 | 12/1994 | Takemoto et al. | 273/143 |
| 5,380,008 | 1/1995 | Mathis et al. | 273/143 |
| 5,441,259 | 8/1995 | Stevenson | 273/143 |
| 5,449,173 | 9/1995 | Thomas et al. | 273/143 |
| 5,580,053 | 12/1996 | Crouch | 463/20 |

FOREIGN PATENT DOCUMENTS

| | | |
|---|---|---|
| 2062922 | 5/1981 | United Kingdom . |
| 2092797 | 8/1982 | United Kingdom . |
| 2098781 | 11/1982 | United Kingdom . |
| 2107103 | 4/1983 | United Kingdom . |
| 2109605 | 6/1983 | United Kingdom . |
| 2135490 | 8/1984 | United Kingdom . |
| 2165385 | 4/1986 | United Kingdom . |
| 2170636 | 8/1986 | United Kingdom . |
| 2177837 | 1/1987 | United Kingdom . |

*Primary Examiner*—George Manuel

*Attorney, Agent, or Firm*—John Edward Roethel

[57] ABSTRACT

The operation of a slot machine is modified by the addition of the step of allowing a player to increase his wager after the reels have begun spinning, and more particularly after at least one reel has stopped spinning and is showing a symbol in the pay line position. In the preferred embodiment, a three reel slot machine is provided and the player may increase the amount of his wager after the first two reels have stopped spinning. With two of the three symbols showing on the pay line, the player may then make an additional wager so that his potential payout for a winning combination is increased. The third reel is then stopped showing all three symbols on the pay line and winning combinations are then paid out based on the amount of the player's wagers.

15 Claims, 4 Drawing Sheets

SLOT MACHINE METHOD

This invention relates to a method of operating a slot machine, and more particularly to a method of operating a slot machine in which the player is provided with an opportunity to increase the amount of his wager after at least one reel has stopped spinning but before all of the reels have stopped spinning.

BACKGROUND OF THE INVENTION

Slot machines using spinning reels have been a classic gaming device for many years. In their earliest embodiment, a player would insert a token to activate the slot machine and then pull a handle to cause the mechanical linkage to commence the spinning of the reels. As the reels slowed down, the first reel would stop, the second reel would stop and finally the third reel would stop displaying one symbol on each reel along a pay line. If the combination of displayed symbols was a winning combination, the player would receive a payout.

Over the years and in keeping with the changes in technology, slot machines have evolved from purely mechanical devices, through electro-mechanical devices to the present day slot machines which are entirely controlled by computer chips. While most of the more popular slot machines still use physical reel strips to display the symbols on the pay line, the operation of the machine is controlled by a computer chip sending signals to the operating mechanism which then determines when to stop each reel in order to display the randomly determined combination of symbols on the pay line.

The traditional three reel slot machine has a glass panel on the front through which the player can view the spinning reels and the resultant stopped positions of the slot reels. In the most basic configuration, a three reel slot machine has a glass panel that is large enough to show three adjoining symbols of the reel strip at one time. The center symbol is usually the pay line symbol, but the player is allowed to see the symbol above the pay line and the symbol below the pay line.

Also, in the traditional three reel slot machine, all three reels are programmed to begin spinning simultaneously when the player pulls on the handle (or presses the SPIN button, which is becoming the more prevalent method of activating the slot machine). The computer controls cause all three reels to spin for a predetermined length of time usually two to three seconds. Then the first reel is caused to stop, followed by the second reel and finally the third reel resulting in the combination of symbols being displayed along the pay line. A pay table is maintained in the computer memory and also displayed to the player on the front of the slot machine. If the three symbols displayed on the pay line are a winning combination, the player receives an award, the size of which is determined by the number of tokens wagered and the particular combination of symbols displayed.

There have been many modifications proposed over the years to this basic operating method of the traditional three reel slot machine. For example, the number of reels have been decreased (the two reel slot machine) or increased (as many as ten reels have been used, the so-called Big Bertha slot machine). Also, the number of pay lines have been increased—since three rows of symbols are traditionally shown in the glass panel, players can wager three tokens to activate each of the three horizontal rows as possible pay line rows. Five way machines have been used in which the player, by wagering five tokens can activate the three horizontal rows and the two diagonal rows as possible winning pay lines. Even an eight way pay line machine has been developed using the three vertical columns as the three additional pay lines.

Modifications have aim been made to the pay tables to vary the method of operation in an attempt to increase the appeal of the slot machine to the player. By inserting additional tokens, the player can multiply the amount of the payouts that a player may receive for a winning combination. Alternatively, by wagering additional tokens, the player can cause additional winning combinations to be activated on any particular spin. For example, for the first token wagered, only the cherries are activated as winning symbols. In order to activate the 7's as winning symbols, the player must wager three tokens.

Various "second chance" propositions have also been implemented on slot machines. These come in a variety of options and these options all become available after the initial spin of the reels has been completed. For example, in the "HOLD" option, the player can select prior to making the first spin whether one or more of the reels will be held or be spun on that pull of the handle. Representative of this type of slot machine is the disclosure in U.S. Pat. No. 4,200,291 (Hooker).

In another variation known as the "NUDGE" option, after the initial spin of the reels has been completed, the player is given the option to "nudge" one of the reels by indexing the reel up or down one or more positions in order to achieve a winning combination. Because the player can see through the glass panel three positions on each reel strip (the pay line position and the position immediately above and immediately below the pay line position), the player can tell when he should or should not "nudge" one of the reels. By adjusting the amount of the payouts made to the player in the pay table, the gaming establishment can still effect a favorable percentage even in the "nudge"-type slot machines. Representative of this type of slot machine is the disclosure in GB 2 062 922 (Parker Great Britain Published Patent Application).

None of these variations allow the player to increase the amount of his wager during the first spin of the reels. In the slot machines known prior to the present invention, the amount of the player's wager is fixed prior to any spin of the reels.

It is an object of the present invention to provide the player with the opportunity to increase the amount of his wager after the commencement of the spinning of the reels.

It is a feature of the present invention that the player may wager additional tokens after the reels have begun spinning, and preferably after at least one of the reels has stopped so that one of the symbols is displayed to the player at the time the player may make his additional wager.

It is an advantage of the present invention that the player can see at least one of the symbols on one of the reel strips in the pay line position at the time the player has the opportunity to make an additional wager. If the player has a favorable symbol positioned on at least one of the reel strips in the pay line position, the player may then make an additional wager so that his payouts can increase for that particular spin of the reels.

Other objects, features and advantages of the present invention will become apparent from a consideration of the following detailed description.

SUMMARY OF THE INVENTION

The operation of a slot machine is modified by the addition of the step of allowing a player to increase his wager after the reels have begun spinning, and more particularly after at least one reel has stopped spinning and is showing a symbol in the pay line position. In the preferred embodiment, a three reel slot machine is provided and the player may increase the mount of his wager after the first two reels have stopped spinning. With two of the three symbols showing on the pay line, the player may then make an additional wager so that his potential payout for a winning combination is increased. The third reel is then stopped showing all three symbols on the pay line and winning combinations are then paid out based on the amount of the player's wagers.

DETAILED DESCRIPTION OF THE PREFERRED EMBODIMENTS

Figure 1:
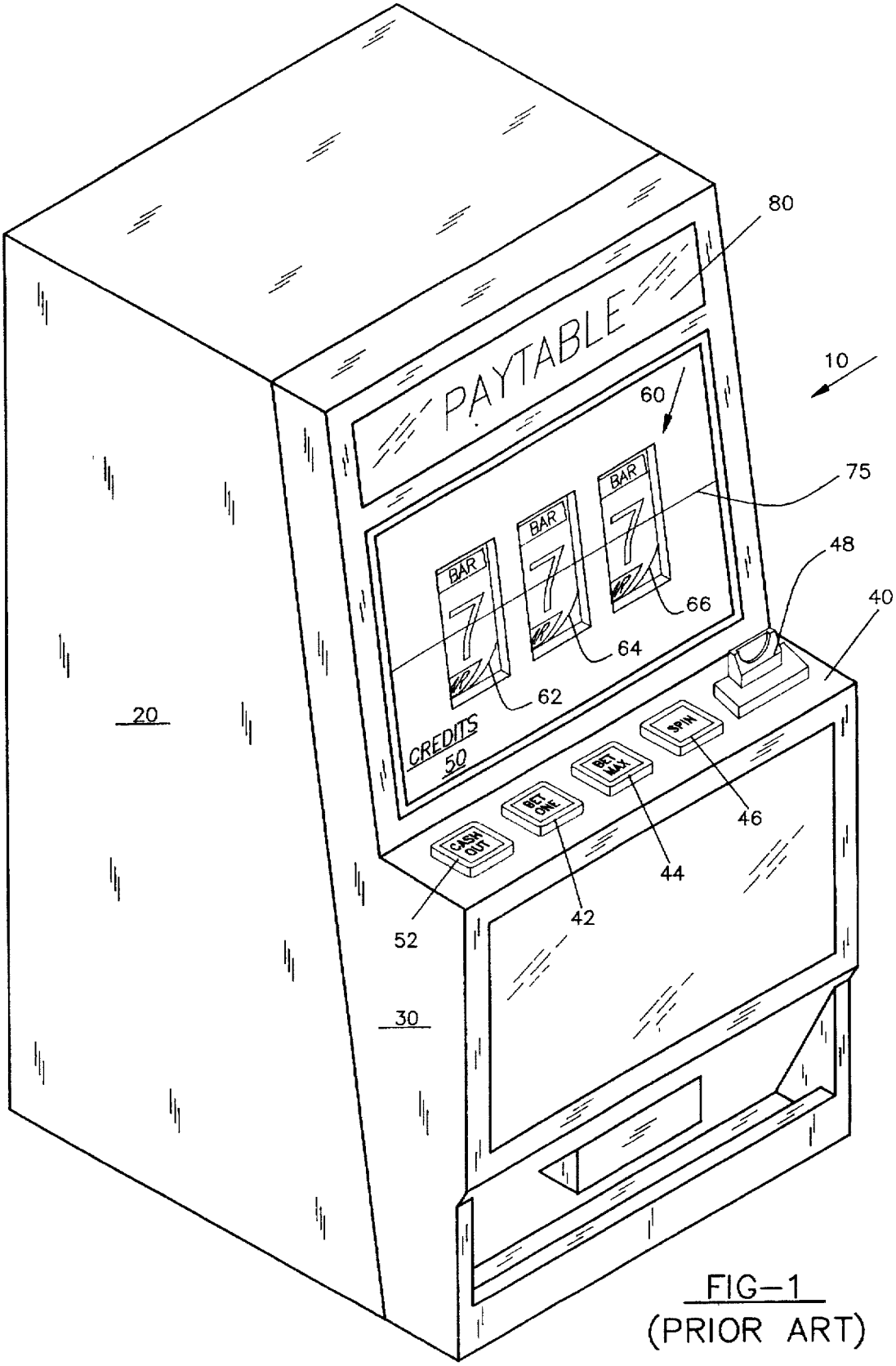
FIG-1 (PRIOR ART)
FIG. 1 shows an isometric view of a traditional three reel slot machine which is prior art to the present invention.

A traditional prior art three reel slot machine is shown generally at 10 in FIG. 1. The slot machine 10 includes a cabinet 20 inside of which are amounted all of the operating parts and electronic control elements that are used to operate and control the slot machine 10. The front of the cabinet 20 includes a door 30 which is hinged to open and close to provide access to the interior of the cabinet 20.

In generally the middle of the door 30 is a door ledge 40 upon which are amounted the buttons by which the player controls the operation of the slot machine 10. As is conventional, the buttons include a "Bet One" button 42 by which the player may wager one token or gaming unit at a time, a "Bet Max" button 44 by which the player may wager the maximum number of tokens or gaming units that are permitted on the slot machine 10 and a "Spin" button 46 by which the player may activate the reels to spin after the player has made his wager. Alternatively, as is conventional, a handle (not shown) can be provided on the side of the cabinet 20 by which the player may also activate the spinning of the reels.

In order for the "Bet One" button 42 or the "Bet Max" button 44 to be usable, the player must have accrued credits on the slot machine 10 which are normally displayed electronically on a credit display 50 located on the slot machine 10. The use of the "Bet One" button 42 or the "Bet Max" button 44 automatically decrements the credit display 50 the appropriate number of credits wagered by the player.

The door ledge 40 also includes a coin head 48 into which the player may insert gaming tokens to activate the slot machine 10, if for example, the player has not accrued credits on the credit display 50.

In the upper area of the door 30, there is provided a glass panel (not shown) through which the player can observe the spinning of the reel apparatus 60. The reel apparatus 60 includes a first reel 62, a second reel 64 and a third reel 66 positioned next to each other. Also as is conventional, each reel is a circular reel strip around the circumference of which are displayed a plurality of symbols.

On the glass panel is printed a pay line 75. As each reel stops spinning, one of the symbols on each of the reel strip stops adjacent the pay line 75 resulting in three symbols being aligned behind the pay line 75. If the three aligned symbols match one of winning combinations, the player receives a payout. Above the reel display area, a pay table display 80 is printed so that player can see what winning combinations need to be achieved on this particular slot machine 10 in order for the player to win. As shown in FIG. 1, the reels have stopped with a "7" displayed at each position behind the pay line 75, and in this case, the player would win the big payout available on this slot machine 10. The amount of the player's win will be added to the credit display 50 and the player may redeem his winnings by pressing the "Cash Out" button 52 on the door ledge 40. The activation of the "Cash Out" button 52 causes a coin hopper (not shown) amounted on the interior of the slot machine 10 to dispense tokens into a coin tray so that the player may collect his winnings.

A typical pay out table 80 for a three reel slot machine with one pay line 75 is shown in Table 1. A player may wager one to three coins or tokens on each spin of the reels and the payout to the player is based on the number of tokens wagered.

TABLE 1

| Symbol Combination | First Coin | Second Coin | Third Coin |
|---|---|---|---|
| 7-7-7 | 200 | 400 | 600 |
| Bar-Bar-Bar | 100 | 200 | 300 |
| Bell-Bell-Bell | 18 | 36 | 54 |
| Plum-Plum-Plum | 14 | 28 | 42 |
| Orange-Orange-Orange | 10 | 20 | 30 |
| Cherry-Cherry-Anything | 5 | 10 | 15 |
| Cherry-Anything-Anything | 2 | 4 | 6 |

Figure 2:
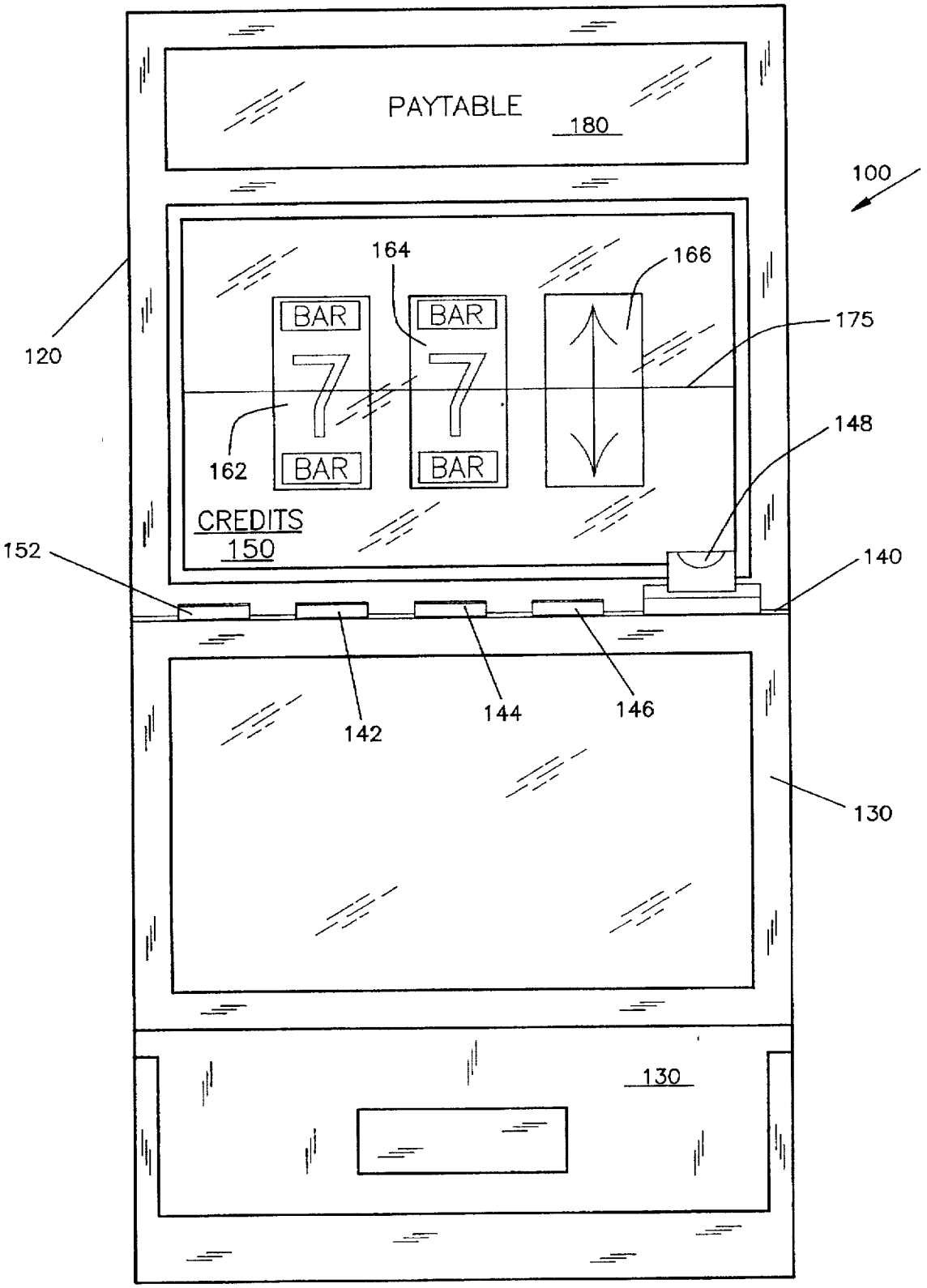
FIG. 2 shows the front view of a three reel slot machine programmed to operate in accordance with the present invention.

FIG. 2 shows a slot machine 100 modified to operate in accordance with the present invention. The physical structure of the slot machine 100 is the same as that used in a conventional slot machine. However, the electronic controls and the software used to operate the slot machine 100 are modified so that the slot machine allows the player the opportunity to increase the amount of his wager after the reels have begun to spin, and preferably after at least one of the reels has stopped spinning and is then displaying a symbol on the pay line of the slot machine while at least one of the other reels continues to spin.

The slot machine 100 includes a cabinet 120 inside of which are amounted all of the operating parts and electronic control elements that are used to operate and control the slot machine 100. The front of the cabinet 120 includes a door 130 through which access to the interior of the cabinet 120 is provided.

On the door ledge 140 the buttons are amounted which include a "Bet One" button 142, a "Bet Max" button 144 and a "Spin" button 146. As in conventional, a handle (not shown) may also be provided on the side of the cabinet 120 as an alternative device used to activate the spinning of the reels. The credit display 150 shows the number of credits accrued by the player. The door ledge 140 also includes a coin head 148 into which the player may insert gaming tokens to activate the slot machine 100.

The reel apparatus 160 includes a first reel 162, a second reel 164 and a third reel 166 positioned next to each other. Also as is conventional, each reel is a circular reel strip around the circumference of which are displayed a plurality of symbols. Also, on the glass panel is printed a pay line 175. Above the reel display area, a pay table display 180 is printed so that player can see what winning combinations need to be achieved on this particular slot machine 100 in order for the player to win.

In the method of operation of the present invention, the player inserts a first wagering token into the coin head 148 to activate the slot machine. Alternatively, the player presses the "Bet One" button 142 or the "Bet Max" button 144 on the slot machine to make a wager assuming that the player has accrued credits showing on the credit display 150.

When the player presses the "Spin" button 146, all three reels begin to spin. In accordance with the computer program and the electronic controls of the slot machine 100, the first reel 162 is caused to stop and then the second reel 164 is caused to stop. However, in the present invention, the third reel 166 continues to spin for a predetermined length of time allowing the player to make an additional wager at this point in the game.

FIG. 2 shows the condition of the slot machine 100 after the first reel 162 and the second reel 164 have stopped spinning and while the third reel 166 continues to spin. At this point the computer software and the electronic controls activate the "Bet One" button 142 and the "Bet Max" button 144 so that the player can make an additional wager. These buttons remain active for a predetermined length of time. During this time period, the player may or may not make an additional wager.

After the time period for extra wagering expires, the computer software and the electronic controls deactivate the "Bet One" button 142 and the "Bet Max" button 144 and the player's ability to make an additional wager is locked out. The third reel is then caused to stop and all three symbols are now displayed on the pay line 175.

If the symbols displayed are a winning combination, the player receives a payout based on the number of coins wagered.

A typical pay out table 180 for a three reel slot machine with one pay line 175 in accordance with the method of operation of the present invention is shown in Table 2. In this particular example, a player may wager one or two coins or tokens at the beginning of the play and the player may wager an additional one token after the first two reels have stopped spinning. The payout to the player is based on the total number of tokens wagered.

TABLE 2

| Symbol Combination | 1st Coin | 2nd Coin | 3rd coin |
|---|---|---|---|
| Wild-Wild-Wild | 250 | 500 | 750 |
| Blue 7-Blue 7-Blue 7 | 100 | 200 | 300 |
| Red 7-Red 7-Red 7 | 40 | 80 | 120 |
| Any 7-Any 7-Any 7 | 25 | 50 | 75 |
| 3 Cherries-3 Cherries-3 Cherries | 20 | 40 | 60 |
| 2 Cherries-2 Cherries-2 Cherries | 15 | 30 | 45 |
| 1 Cherry-1 Cherry-1 Cherry | 5 | 10 | 15 |
| Any Cherry-Any Cherry-Any Cherry | 3 | 6 | 9 |

Any suitable payout table may be used based on the hold percentage desired by the operator of the gaming machine. It is also within the scope of the present invention to use a payout table that includes progressive amounts that increase as more coins or tokens are wagered until someone achieves the winning combination and wins the progressive amount. Both fixed amounts and progressive amounts could be combined into a single table. With reference to Table 2, for example, instead of the payout for three coins wagered and three wild symbols being achieved being a flat 750 coins, this payout could be a progressive amount that increases for each spin of the reels until the winning combination is achieved, while the remaining winning combinations all stay as fixed amounts.

It is also within the scope of the present invention to allow more than one coin or token to be wagered after at least the first reel has stopped spinning and before at least the last reel has stopped spinning. As one example, a player could wager one or two coins to commence the spin of the reels and then the player could wager one or two additional coins to buy additional columns of the payout table in hopes of achieving a higher payout. With reference to table 2, to conform to this example a fourth coin payout column could be added. Again, the payouts could be either fixed amounts, progressive amounts or combinations of fixed amounts and progressive amounts as desired.

The method of the present invention has been described above in connection with a three reel slot machine having a single pay line. However, various alternatives to the present invention are contemplated and are to be considered within the scope of the present invention.

Figure 3:
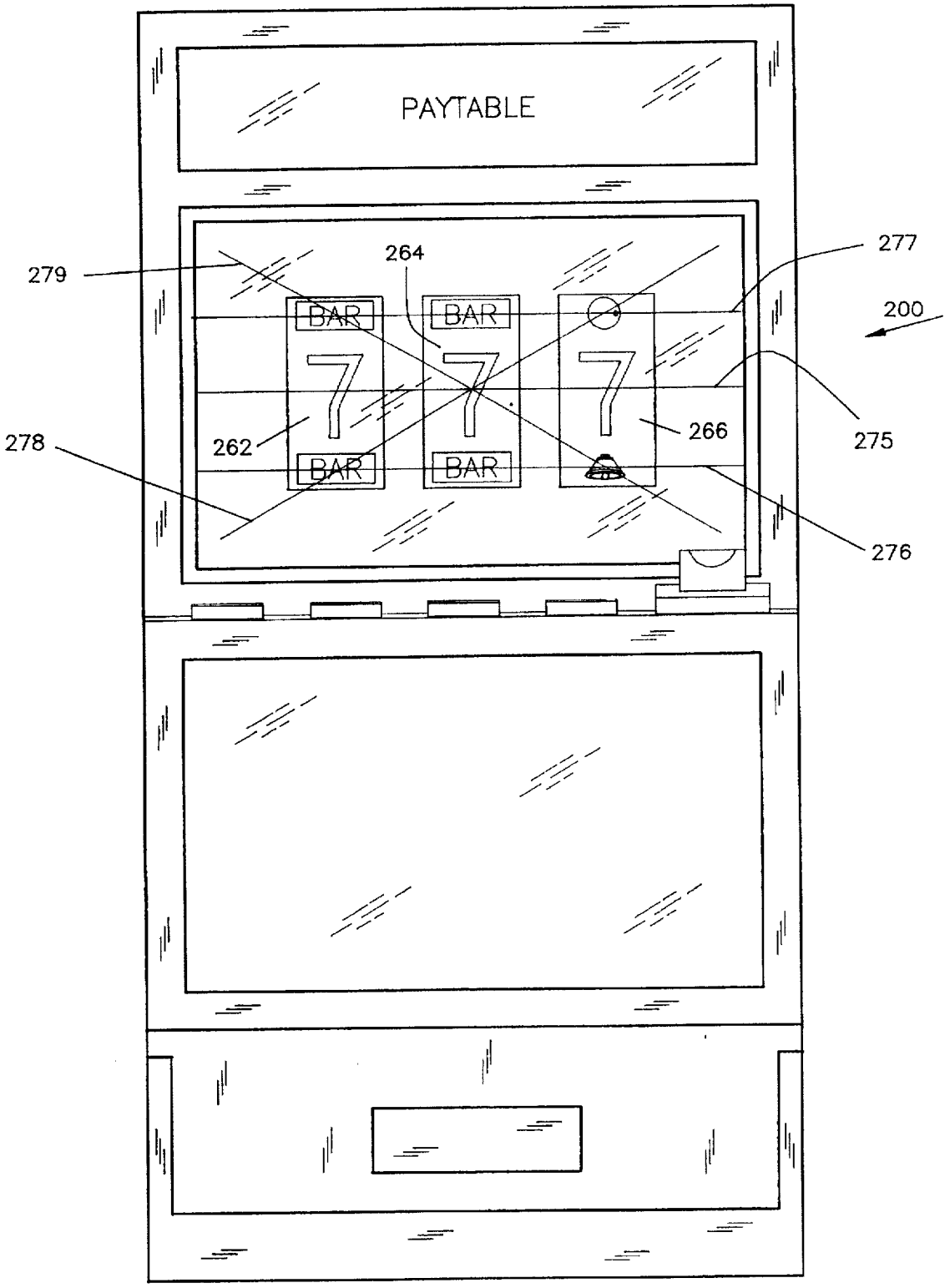
FIG. 3 shows the front view of a three reel slot machine programmed to operate in accordance with a modified method of the present invention in which multiple pay lines are used.

For example, as shown in FIG. 3, a three reel slot machine 200 is provided with multiple pay lines 275, 276, 277, 278 and 279. As is conventional in multiple pay line machines, each coin or token wagered by the player activates a different pay line for possible winning combinations. Since each pay line includes at least one symbol on the third reel 266, the method of the present invention can also be applied to a multiple pay line slot machine.

A payout table similar to that shown in table 2 would be developed for these multiple pay line machines of the present invention. The payout table would be based on the number of coins or tokens wagered by the player. Again, the payouts could be either fixed amounts, progressive amounts or combinations of fixed amounts and progressive amounts as desired. As is typical in multiple pay line machines, the player would be awarded his winning amount for each winning combination that lines up on one or more of the multiple pay lines. However, it is also possible to provide that only the winning combination with the highest winning payout would be paid by the gaming machine.

In the embodiment of the present invention using a three reel slot machine, it is also possible to provide the player with two additional opportunities to increase his wager, instead of only one such possibility as described above. The first additional opportunity can be allowed after the first reel 262 has stopped spinning but before the second reel 264 and the third reel 266 stop spinning. The second additional opportunity can be allowed after the first reel 262 and the second reel 264 have stopped spinning but before the third reel 266 stops spinning. The method of operation can be structured so that the player is only provided the second additional opportunity if the player has exercised the first additional opportunity, or alternatively, the player may exercise the second additional opportunity even if the player did not exercise the first additional opportunity.

Figure 4:
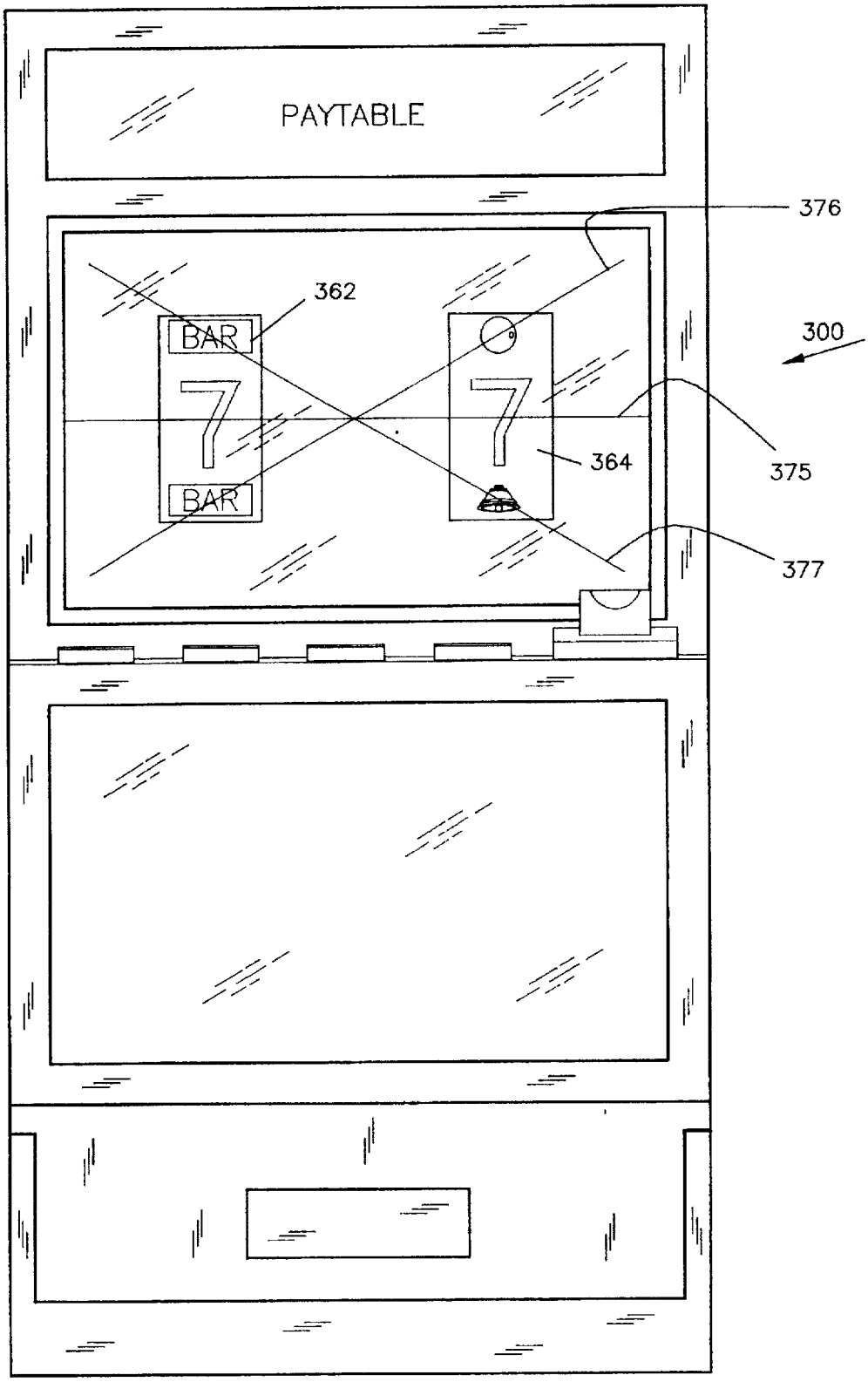
FIG. 4 shows the front view of a two reel slot machine programmed to operate in accordance with the present invention.

In another alternative, the method of the present invention can be practiced using a slot machine that has only two reels. In this embodiment as shown in FIG. 4, a two reel slot machine 300 is shown and the first reel 362 would cause to be stopped and then the player would have the option of making an additional wager prior to the time period when the second reel 364 would be caused to stop. In this embodiment of the present invention, either a single pay line two reel machine may be used or, as shown in FIG. 4, a multiple pay line two reel slot machine 300 may be used with three pay lines 375, 376 and 377 be activated as the player wagers the first, second and third coins or tokens.

Again, a payout table similar to that shown in table 2 would be developed for these two reel machines with or without multiple pay lines. The payout table would be based on the number of coins or tokens wagered by the player. Again, the payouts could be either fixed amounts, progressive amounts or combinations of fixed amounts and progressive amounts as desired.

The method of the present invention can also be practiced using slot machines having four or more reels, either with one or multiple pay lines. It is also possible to allow the player to make an additional wager after only the first reel has stopped spinning, but while any of the other remaining reels continue to spin.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claim:

1. A method of operating a slot machine having at least a first reel and a second reel, each with symbols thereon comprising:

a) inserting at least a first wagering token to activate the slot machine;

b) activating the first reel and the second reel to spin;

c) randomly stopping the first reel;

d) providing an opportunity to wager at least another wagering token after the first reel has stopped spinning but before the second reel has stopped spinning;

e) randomly stopping the second reel;

f) determining whether a winning combination is displayed by the first reel and the second reel;

g) if a winning combination appears, awarding the player an amount based on a total number of the tokens wagered by the player.

2. The method of claim 1 in which a single pay line is provided to determine whether the winning combination has been achieved.

3. The method of claim 1 in which multiple pay lines are provided to determine whether one or more winning combinations have been achieved.

4. The method of claim 1 in which the amount awarded to the player for a winning combination is a fixed amount.

5. The method of claim 1 in which the amount awarded to the player for a winning combination is a progressive amount.

6. A method of operating a slot machine having at least a first reel, a second reel and a third reel, each with symbols thereon comprising:

a) inserting at least a first wagering token to activate the slot machine;

b) activating the first reel, the second reel and the third reel to spin;

c) randomly stopping the first reel and the second reel;

d) providing an opportunity to wager at least another wagering token after the first reel and second reel have stopped spinning but before the third reel has stopped spinning;

e) randomly stopping the third reel;

f) determining whether a winning combination is displayed by the first reel, second reel and the third reel;

g) if a winning combination appears, awarding the player an amount based on a total number of the tokens wagered by the player.

7. The method of claim 6 in which a single pay line is provided to determine whether the winning combination has been achieved.

8. The method of claim 6 in which multiple pay lines are provided to determine whether one or more winning combinations have been achieved.

9. The method of claim 6 in which the amount awarded to the player for a winning combination is a fixed amount.

10. The method of claim 6 in which the amount awarded to the player for a winning combination is a progressive amount.

11. A method of operating a slot machine having at least a first reel, a second reel and a third reel, each with symbols thereon comprising:

a) inserting at least a first wagering token to activate the slot machine;

b) activating the first reel, the second reel and the third reel to spin;

c) randomly stopping the first reel;

d) providing an opportunity to wager at least another wagering token after the first reel has stopped spinning but before the second reel and third reel have stopped spinning;

e) randomly stopping the second reel;

f) providing an opportunity to wager at least another wagering token after the first reel and second reel have stopped spinning but before the third reel has stopped spinning;

g) randomly stopping the third reel;

h) determining whether a winning combination is displayed by the first reel, second reel and the third reel;

i) if a winning combination appears, awarding the player an amount based on a total number of the tokens wagered by the player.

12. The method of claim 11 in which a single pay line is provided to determine whether the winning combination has been achieved.

13. The method of claim 11 in which multiple pay lines are provided to determine whether one or more winning combinations have been achieved.

14. The method of claim 11 in which the amount awarded to the player for a winning combination is a fixed amount.

15. The method of claim 11 in which the amount awarded to the player for a winning combination is a progressive amount.

* * * * *